US011130011B2

(12) United States Patent
Wang

(10) Patent No.: US 11,130,011 B2
(45) Date of Patent: Sep. 28, 2021

(54) CLOSED TRAMPOLINE FRAME AND TRAMPOLINE WITH THE CLOSED TRAMPOLINE FRAME

(71) Applicant: Yongqi Wang, Guangdong (CN)

(72) Inventor: Yongqi Wang, Guangdong (CN)

( * ) Notice: Subject to any disclaimer, the term of this patent is extended or adjusted under 35 U.S.C. 154(b) by 11 days.

(21) Appl. No.: 16/734,360

(22) Filed: Jan. 5, 2020

(65) Prior Publication Data

US 2021/0187338 A1 Jun. 24, 2021

(30) Foreign Application Priority Data

Dec. 19, 2019 (CN) ..... 201911316064.1

(51) Int. Cl.
*A63B 5/11* (2006.01)

(52) U.S. Cl.
CPC ..... *A63B 5/11* (2013.01); *A63B 2210/50* (2013.01); *A63B 2225/09* (2013.01)

(58) Field of Classification Search
CPC ..... A63B 21/026; A63B 5/11; A63B 5/08; A63B 5/12; A63B 5/16
See application file for complete search history.

(56) References Cited

U.S. PATENT DOCUMENTS

| | | | | |
|---|---|---|---|---|
| 4,339,123 | A * | 7/1982 | Rich | A63B 5/11 403/205 |
| 8,137,242 | B2 * | 3/2012 | VanElverdinghe | A63B 5/11 482/27 |
| 8,303,469 | B2 * | 11/2012 | Alexander | A63B 5/11 482/27 |
| 10,010,736 | B2 | 7/2018 | Chen | |
| 10,092,787 | B2 | 10/2018 | Chen | |
| 10,124,199 | B2 * | 11/2018 | Andon | A63B 5/11 |

FOREIGN PATENT DOCUMENTS

CN 207297539 U 5/2018

* cited by examiner

*Primary Examiner* — Nyca T Nguyen
*Assistant Examiner* — Andrew M Kobylarz

(57) ABSTRACT

A closed trampoline frame includes multiple frame pipes which are connecting in turns, the adjacent frame pipes are connected by a frame connector. The frame connector is a T-pipe composed of a horizontal pipe and a vertical pipe. Its outer diameter of the horizontal pipe is smaller than that of the frame pipe; its two ends of the horizontal pipe are inserted into the adjacent frame pipes. The top and the bottom of the frame pipe are provided with upper frame holes and lower frame holes. The top and the bottom of the horizontal pipe are provided with upper holes and lower holes. When its two ends of the horizontal pipe are inserted into the adjacent frame tubes, each of the upper holes coincides with one of the upper frame hole, and each of the lower holes coincides with one of the lower frame hole.

9 Claims, 2 Drawing Sheets

CLOSED TRAMPOLINE FRAME AND TRAMPOLINE WITH THE CLOSED TRAMPOLINE FRAME

TECHNICAL FIELD

The invention relates to the technical field of trampoline, in particular, to closed trampoline frame and a trampoline with the closed trampoline frame.

BACKGROUND

Trampoline exercise is a healthy and interesting entertainment. Studies have shown that trampoline exercise can not only exercise the body and strengthen muscle strength, but also help people develop a sense of balance and improve sports skills. With the development of technology, trampoline is entering people's life more and more. The basic structure of trampoline includes a springpad, a frame, multiple flexible rods, supporting legs, a protective net and supporting rods. The tops of the flexible rods are arranged around the periphery of the springpad, and the bottom ends of the flexible rods are mounted on the frame, so that the springpad is mounted above the frame. The frame is mounted on the ground through supporting by the support legs. The protective net is arranged around the periphery of the springpad and extends up to form a closed or semi-closed space for jumping. The protective net protects people moving on the springpad from falling off the springpad. The supporting rod is arranged around the springboard and used to supporting the top of the protective net.

The frame of the existing trampoline is mostly composed of multiple straight pipes and/or arc tubes, the joint of the two tubes is welded, screw connected or connected by connector. For example, the Chinese utility model patent CN201721278304.X exposes a trampoline frame connector, which has a frame connector connected to a first horizontal member. The frame connector is also connected to a second horizontal member. A trampoline leg includes a vertical leg member connected to a horizontal leg member.

The existing trampoline frame has the following shortcomings:

1. The size of the trampoline frame can not be adjusted, it can not meet the requirements of different users at the same time.
2. It has to be installed by the professionals, the installation is difficult.
3. It is not convenient to install flexible rod on trampoline frame connector, and the distribution of flexible rod is uneven, which affects the elasticity of springpad.
4. In the process of jumping, the relative rotation will be sent between the tubes, resulting in a harsh friction sound.

SUMMARY

In order to overcome the shortcomings of the prior art, the invention provides a closed trampoline frame and a trampoline with the closed trampoline frame, which can overcome the above defects of the existing trampoline frame, it is convenient to disassemble and assemble, and it can flexibly adjust the size of the trampoline.

The technical proposals of the present invention are as follows:

A closed trampoline frame includes multiple frame pipes which are connecting in turns, and each frame pipe is connected to an adjacent frame pipe by a frame connector. The frame connector is a T-pipe composed of a horizontal pipe and a vertical pipe. An outer diameter of the horizontal pipe is slightly smaller than an inner diameter of the frame pipe; each end of the horizontal pipe is inserted into adjacent the frame pipes so as to form the closed trampoline frame. The tops of the frame pipes are provided with a plurality of upper frame holes, the bottoms of the frame pipe are provided with a plurality of lower frame holes in pairs, and the upper frame holes and the lower frame holes are staggered in pairs. The top of the horizontal pipe is provided with a plurality of upper holes, The bottom of the horizontal pipe is provided with a plurality of lower holes, and the upper holes and the lower holes are staggered in pairs. When each end of the horizontal pipe is inserted into adjacent the frame pipes, each of the upper holes coincides with one of the upper frame holes, and each of the lower holes coincides with one of the lower frame holes.

One end of the frame connector is fixed to one of the adjacent frame pipes.

Two adjacent the vertical pipes are fixed and connected by a connecting pipe.

The horizontal pipe and the vertical pipe are integrally formed, or are connected by welding, riveting or screwing.

The closed trampoline frame is round or elliptical, which is composed of a plurality of curved the frame pipes The bottom of the fame pipe is provided with a notch through which the vertical pipe passes.

Adjacent the frame connectors are connected through a supporting frame; the supporting frame includes two curved pipes and a horizontal connecting pipe connected with the two curved pipes; the top ends of the two curved pipes are inserted into the vertical pipe.

The frame pipe is also provided with a supporting rod pipe, and a supporting rod is inserted in the supporting rod pipe; and a reinforcing rib is arranged between the frame pipe and the supporting rod pipe.

The invention also provides a trampoline with the above trampoline frame.

The beneficial effects of the invention are as follows: the closed trampoline frame is enclosed by connecting multiple frame pipes, and the adjacent frame pipes are connected by a frame connector. The frame connector is a T-pipe composed of a horizontal pipe and a vertical pipe. Its outer diameter of the horizontal pipe is slightly smaller than its inner diameter of the frame pipe; the two ends of the horizontal pipe are inserted into the adjacent frame pipes so as to form the closed trampoline frame. The top and the bottom of the frame pipe are provided with a plurality of upper frame holes and lower frame holes in pairs, and the upper frame holes and the lower frame holes are staggered in pairs. The top and the bottom of the horizontal pipe are provided with a plurality of upper and lower holes in pairs, and the upper holes and the lower holes are staggered in pairs. When the two ends of the horizontal pipe are inserted into the adjacent frame tube, each of the upper holes coincides with the upper frame hole, and each of the lower holes coincides with the lower frame hole. After the flexible rod of the trampoline is inserted into the upper frame hole and the lower frame hole, and the corresponding upper hole and the lower hole, the adjacent frame pipe can not rotate relatively, and the stability of the increased trampoline is increased. When people jump on the trampoline, it will not produce friction sound of relative rotation of steel pipe, it is a silent trampoline, which is convenient to disassemble and assemble, and the size of trampoline can be adjusted flexibly.

DETAILED DESCRIPTION OF EMBODIMENTS

Figure 1:
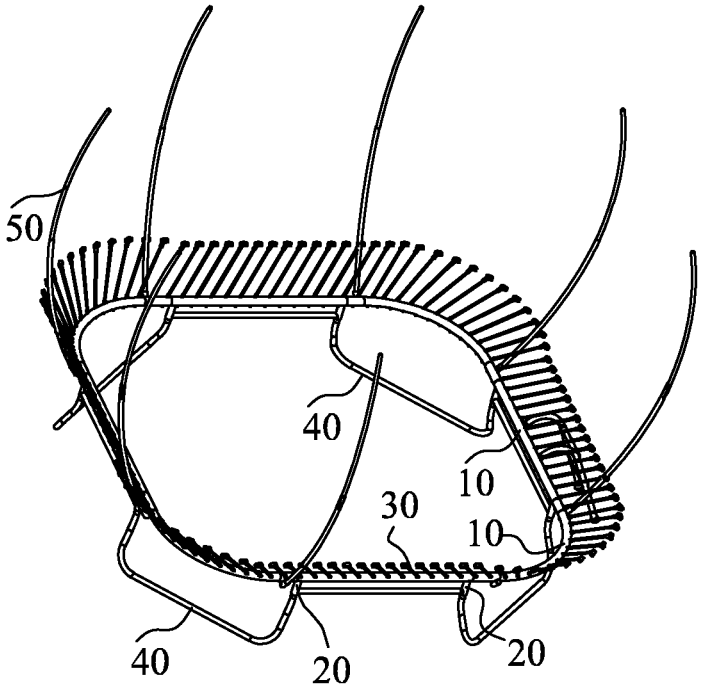
FIG. 1 is a perspective view of the closed trampoline frame according to the present invention.
Figure 2:
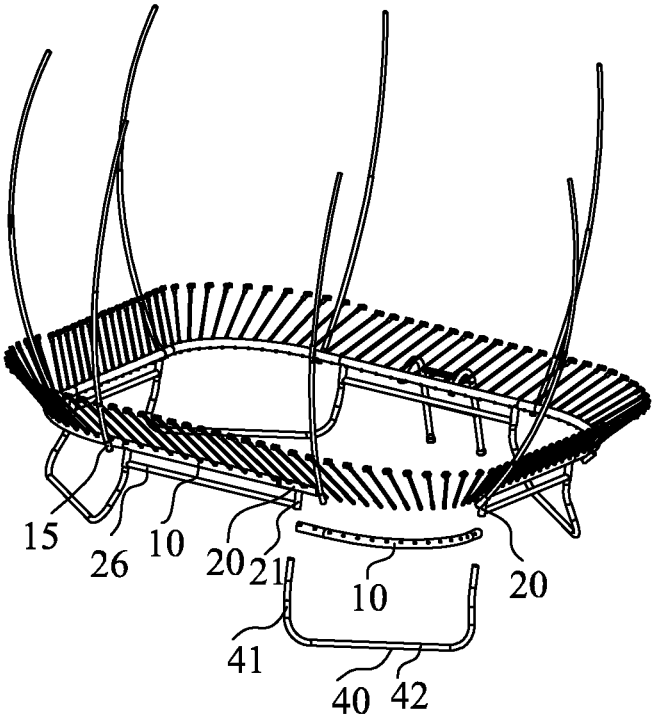
FIG. 2 is an exploded view of FIG. 1.

For the purpose of the invention, the technical scheme and the technical effect are more clearly understood, and the invention will be further described in the following with reference to specific embodiments. It should be understood that the specific embodiments described herein are for illustrative purposes only and are not intended to limit the invention.

Referring to FIGS. 1, 2, 3 and 4, a closed trampoline frame includes multiple frame pipes 10 which are connected in turns, each frame pipe 10 is connected to an adjacent frame pipe 10 by a frame connector 20. The frame connector 20 is a T-pipe composed of a horizontal pipe 21 and a vertical pipe 22. The horizontal pipe 21 and the vertical pipe 22 are integrally formed, or are connected by welding, riveting or screwing. An outer diameter of the horizontal pipe 21 is slightly smaller than an inner diameter of the frame pipe 22. Each end of the horizontal pipe 21 is inserted into adjacent the frame pipes 10 so as to form the closed trampoline frame. When the closed trampoline frame is assembled and disassembled, it is only necessary to insert both ends of the horizontal pipe 21 into adjacent the frame pipes 10 or pull both ends of the horizontal pipe 21 out adjacent the frame pipes 10. The disassembly and assembly is very simple and convenient, and there is no need for additional tools.

Figure 3:
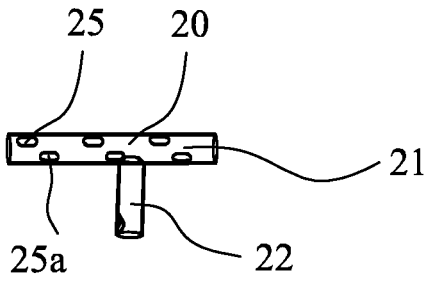
FIG. 3 is a perspective view of the frame connector according to the present invention.
Figure 4:
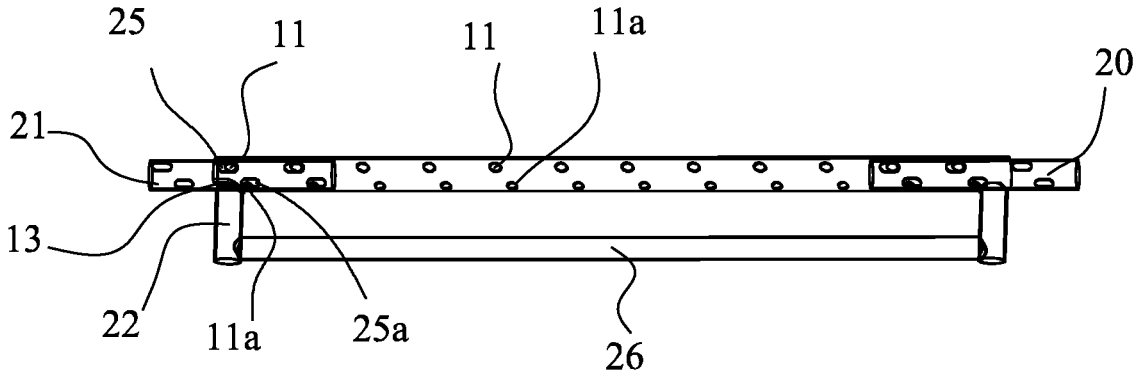
FIG. 4 is a combination view of the frame connector 20 and the frame pipe 10 according to the present invention.

Referring to FIG. 4, preferably, the tops of the frame pipes are provided with a plurality of upper frame holes 11 at equal space, the bottoms of the frame pipes are provided with a plurality of lower frame holes 11*a*, and the upper frame holes 11 and the lower frame holes 11*a* are staggered in pairs. These structure is designed to facilitate the installation of flexible rods 30. Each of the flexible rods 30 of the trampoline is inclined relative to the frame pipes 10 and inserted into a pair of stagged upper frame hole 11 and lower frame hole 11. Referring to FIG. 3 and FIG. 4, the top of the horizontal pipe 21 is provided with a plurality of upper holes 25, the bottom of the horizontal pipe is provided with a plurality of lower holes 25*a*, and the upper holes 25 and the lower holes 25*a* are staggered in pairs. When its two ends of the horizontal pipe 21 are inserted into adjacent the frame pipes 10, each of the upper holes 25 coincides with one of the upper frame hole 11, and each of the lower holes 25*a* coincides with one of the lower frame hole 11*a*. At the frame connector 20, the flexible rod 30 is inclined relative to the frame pipe 10 and inserted into a pair of staggered upper frame hole 11 and lower frame hole 11, and simultaneously inserted into a pair of staggered upper hole 25 and the lower upper hole 25*a* coinciding to the pair of upper frame hole 11 and lower frame hole 11*a*. This structure fixes the frame connector 20 to the frame pipe 10 to prevent relative rotation of the frame connector 20 and increases the stability of the trampoline. Preferably, in one embodiment of the invention, one end of the frame connector 20 is fixedly connected to one of the adjacent frame pipes 10. The connecting mode is preferably welded. On one hand, the structure eliminates the relative rotation of the frame connector 20 and the frame pipe 10, thereby resulting the trampoline more stable, avoiding friction sound to be produced, on the other hand, when the trampoline frame is installed, it is only necessary to insert the other end of the frame connector 20 into the adjacent frame pipe 10. The installation is simple and convenient.

In one embodiment of the present invention, the closed trampoline frame is round or approximately circular and, which is composed of a plurality of curved frame pipes. Its outer diameter of the horizontal pipe 21 is slightly smaller than the inner diameter of the curved frame pipe. The both ends of the horizontal pipe 21 are inserted into the adjacent curved frame pipes, thereby forming a round or approximately circular trampoline frame.

In one embodiment of the present invention, the trampoline frame is an approximate square or rectangle, which is composed of a plurality of straight frame pipes and four curved frame pipes. The straight frame pipes and the curved frame pipes have the same inner diameter. The two ends of each of the horizontal pipes 21 are inserted into the straight frame pipe and the curved frame pipe adjacent to each other, or into two adjacent the straight frame pipes 10. In the trampoline frame similar to a square as shown in FIG. 1, the four corners of the trampoline frame are the curved frame pipes 10, the four sides of the trampoline frame are the straight frame pipes 10 respectively. In the trampoline frame similar to a rectangle, the four corners of the trampoline frame corners the curved frame pipes 10, one pairs of opposite sides of the trampoline frame are a the straight frame pipes 10 respectively, the other pairs of opposite sides have at least two straight frame pipes 10. All of the straight frame pipes 10 are of the same specification, thereby reducing die costs and facilitating production, transportation and assembly. In the trampoline frame, the number of the straight frame pipes 10 can be adjusted according to the actual needs, so as to adjust the size of the trampoline to meet the needs of different users.

The bottom of the fame pipe 10 is provided with a notch 13 through which the vertical pipe 22 passes, facilitating the installation and disassembly of the frame connector 20.

Adjacent the frame connector 20 is connected through a supporting frame 40. The supporting frame 40 includes two curved pipes 41 and a horizontal connecting pipe 42 connected with the two curved pipes 41. The top ends of the two curved pipes 41 are inserted into the vertical pipe 22. The horizontal connecting pipe 42 is placed on the ground, thereby supporting the trampoline frame on the ground.

Two adjacent the vertical pipes 22 are fixed and connected by a connecting pipe 26. The connecting pipe 26 strengthens the stability of the connection, thus making the trampoline frame more secure.

The frame pipe 10 is also provided with a supporting rod pipe 15, and a supporting rod 50 is inserted in the supporting rod pipe 15; and a reinforcing rib is arranged between the frame pipe 10 and the supporting rod pipe 15, which is strengthens the stability of the connection.

The invention also provides a trampoline with the trampoline frame. Since the structure of the trampoline is known to the existing technology and is known to the technical personnel in the field, this application will not repeat it.

The above is a further detailed description of the invention in combination with a specific preferred embodiment, and it can not be concluded that the specific implementation of the invention is limited to these instructions. For the general technical personnel in the technical field to which the invention belongs, without being separated from the conception of the invention, the architecture form can be flexible and changeable, and a series of products can be derived. If it is just making a number of simple deductions or substitutes should be regarded as falling within the scope of patent protection determined by the claim submitted by the present invention.

What is claimed:

1. A closed trampoline frame, including multiple frame pipes which are connecting in turns, wherein each frame pipe is connected to an adjacent frame pipe by a frame connector, said frame connector is a T-pipe composed of a horizontal pipe and a vertical pipe; an outer diameter of said horizontal pipe is slightly smaller than an inner diameter of said frame pipe; each end of said horizontal pipe is inserted into adjacent said frame pipes so as to form said closed trampoline frame; tops of said frame pipes are provided with a plurality of upper frame holes at equal space, bottoms of said frame pipes are provided with a plurality of lower frame holes at equal space, and said upper frame holes and said lower frame holes are staggered in pairs; a top of said horizontal pipe is provided with a plurality of upper holes, a bottom of said horizontal pipe is provided with a plurality of lower holes, and said upper holes and said lower holes are staggered in pairs; when each end of said horizontal pipe is inserted into adjacent said frame pipes, each of said upper holes coincides with one of said upper frame hole, and each of said lower holes coincides with one of said lower frame hole.

2. The closed trampoline frame according to claim 1, wherein one end of said frame connector is fixed to one of adjacent said frame pipes.

3. The closed trampoline frame according to claim 1, wherein two adjacent said vertical pipes are fixed and connected by a connecting pipe.

4. The closed trampoline frame according to claim 1, wherein said horizontal pipe and said vertical pipe are integrally formed, or are connected by welding, riveting or screwing.

5. The closed trampoline frame according to claim 1, wherein said closed trampoline frame is round or approximately circular and, which is composed of a plurality of curved said frame pipes.

6. The closed trampoline frame according to claim 1, wherein said closed trampoline frame is an approximate square or rectangle, which is composed of a plurality of straight said frame pipes and four curved said frame pipes.

7. The closed trampoline frame according to claim 1, wherein said bottom of each said frame pipe is provided with a notch through which said vertical pipe passes.

8. The closed trampoline frame according to claim 1, wherein adjacent said frame connectors are connected through a supporting frame; said supporting frame includes two curved pipes and a horizontal connecting pipe connected with said two curved pipes; top ends of said two curved pipes are inserted into said vertical pipe.

9. A trampoline, including a plurality of flexible rods, wherein said trampoline has a closed trampoline frame, including multiple frame pipes which are connecting in turns, wherein each frame pipe is connected to an adjacent frame pipe by a frame connector, said frame connector is a T-pipe composed of a horizontal pipe and a vertical pipe; an outer diameter of said horizontal pipe is slightly smaller than an inner diameter of said frame pipe; each end of said horizontal pipe is inserted into adjacent said frame pipes so as to form said closed trampoline frame; tops of said frame pipes are provided with a plurality of upper frame holes at equal space, bottoms of said frame pipes are provided with a plurality of lower frame holes at equal space, and said upper frame holes and said lower frame holes are staggered in pairs; a top of said horizontal pipe is provided with a plurality of upper holes, a bottom of said horizontal pipe is provided with a plurality of lower holes, and said upper holes and said lower holes are staggered in pairs; when each end of said horizontal pipe is inserted into adjacent said frame pipes, each of said upper holes coincides with one of said upper frame hole, and each of said lower holes coincides with one of said lower frame hole.

* * * * *